United States Patent [19]

Whiteman

[11] Patent Number: 4,748,829

[45] Date of Patent: Jun. 7, 1988

[54] COMBINED HEATING AND COOLING APPARATUS

[76] Inventor: Gary D. Whiteman, 2630 Townsgate Rd., Westlake Village, Calif. 91362-3896

[21] Appl. No.: 947,981

[22] Filed: Dec. 31, 1986

[51] Int. Cl.[4] ..... F25B 29/00

[52] U.S. Cl. ..... 62/325; 137/597

[58] Field of Search ..... 62/325, 139; 137/597

[56] References Cited

U.S. PATENT DOCUMENTS 3,084,522 4/1963 Hames, Jr. et al. ..... 62/325

3,143,864 8/1964 Schordine ..... 62/325

FOREIGN PATENT DOCUMENTS 2264253 2/1973 France ..... 62/325

*Primary Examiner*—William E. Wayner

*Attorney, Agent, or Firm*—Poms, Smith, Lande & Rose

[57] ABSTRACT

A combined heating and air conditioning unit has a condenser for cooling compressed working fluid and an evaporator for expanding the working fluid and to cool it. A centrifugal blower pulls air through the condenser into one side of the blower and pulls cool air through the evaporator into the other side of the blower. A divider in the center of the blower prevents the cool air from the evaporator and warm air from the condenser from mixing. At the output of the blower, a valve is provided at the output and connected to the delivery duct so that warm air from one side of the blower or cold air from the other is delivered to the duct, and the air not delivered to the duct is exhausted to the atmosphere. The valve may also allow some mixing of the warm and cold air.

2 Claims, 2 Drawing Sheets

COMBINED HEATING AND COOLING APPARATUS

BACKGROUND OF THE INVENTION

1. Field of the Invention:

The present invention relates to a unit that can produce hot or cold air for space heating or air conditioning.

2. Description of the Prior Art:

An electrical, oil or natural gas heater and a separate air conditioner are usually used for alternative cooling (air conditioning) or heating of interiors. In a forced air heating system, a fan or blower blows the heated air through ducts into the rooms. The evaporator or cooling unit of the air conditioner is usually located adjacent the heater unit so that the blower of the heater can blow cold air through the evaporator where it flows through the same ducting.

In the standard air conditioning thermodynamic cycle, a compressor pressurizes a working fluid (normally a fluorocarbon). The compression adds heat to the working fluid. The working fluid then flows to a condenser where the added heat is expelled to the atmosphere. Many air conditioners have the compressor and condenser mounted in a single unit outside of the house so that the heat in the condenser can be expelled to the atmosphere. The condenser is a heat exchanger and a separate blower forces outside air past the condenser where it cools the working fluid. The working fluid then travels through tubing to the evaporator, which is located adjacent to the blower of the heater in conventional home systems. The pressurized working fluid in the evaporator expands, which causes it to lose heat. The heater blower of the forced air system passes air over the cold evaporator so the air cools, and the blower forces the colder air into the house ducting. The working fluid is then pumped back into the compressor where the cycle is repeated.

Systems have also been devised to use the normally waste heat from the condenser for heating so that the system could eliminate a separate space heater. It is difficult, however, to design such a system for a portable unit. One type of portable unit is a pre-cooler unit such as that described in applicant's U.S. patent application Ser. No. 675,815, filed Nov. 28, 1984 entitled "Airplane Airconditioner." That unit is portable and designed to direct cool, air conditioned air into the cabin of an airplane while it is still on the ground. Although the main discussion in that patent application relates to cooling the cabin of an airplane parked on a hot day, there are many instances when it would be desirable to heat the inside of the cabin.

One could, in theory, use the normally wasted heat in the standard condenser for space heating purposes. There are problems in attempting to use the condenser in this way in standard air conditioning units because of natural inefficiencies in the system. The consenser is designed to maximize the exchange of heat to the outside air to increase the efficiency of air conditioning. The condenser is not necessarily properly sized for controlled heating of forced air. Also, many air conditioners use a centrifugal blower, which blows cold air into its center and force it outward. One cannot use such a blower to create the opposite air flow, which would be needed to reverse the air flow through the condenser. Making systems more complicated, makes them too large to be easily portable.

SUMMARY OF THE INVENTION

It is an object of the present invention to disclose and provide a unit for alternatively space heating and cooling that overcomes many of the problems in the prior art. The unit is efficient in both heating and air conditioning, can switch rapidly between the two conditions and is small enough to be easily portable. Another object of the present invention is to disclose and provide a unit that does not sacrifice the cooling efficiency of a properly sized evaporator nor the heat removing efficiency of a properly designed condenser in a unit that can alternate between heating and cooling. Another object of the present invention is to disclose and provide such a device, which can also mix warm and air conditioned air for proper temperature maintenance.

The unit for alternatively space heating and cooling of the present invention has a compressor for compressing a working fluid, a condenser for expelling heat from the compressed working fluid and an evaporator for expanding working fluid to cool the working fluid. To allow alternate heating or air conditioning the device has been improved by having a blower adjacent the condenser and the evaporator for drawing ambient air through the condenser and the evaporator into the blower. A divider in the blower blocks mixing of the air from the condenser and from the evaporator in the blower and maintains the flow of air in first and second air flows. A valve in the path of the first and second flows directs (a) the first flow to an outlet and exhausts the second flow or (b) exhausts the first flow and directs the second flow to an outlet. The outlet is connected to the room or other space being heated or air conditioned. The valve can also direct part of a flow to the outlet and exhaust the rest if one wants mixing of the flows.

The valve has a center wall extending from the divider and two sidewalls. Two valve plates, one on each side of the center wall, each pivot together between one sidewall and the center plate to direct the air from the side of the blower on each side of the divider. Intermediate positions are also possible. The blower divider is a thin plate, approximately at the center of the blower and perpendicular to the axis of rotation of the blower.

DETAILED DESCRIPTION OF THE PREFERRED EMBODIMENT

Figure 1:
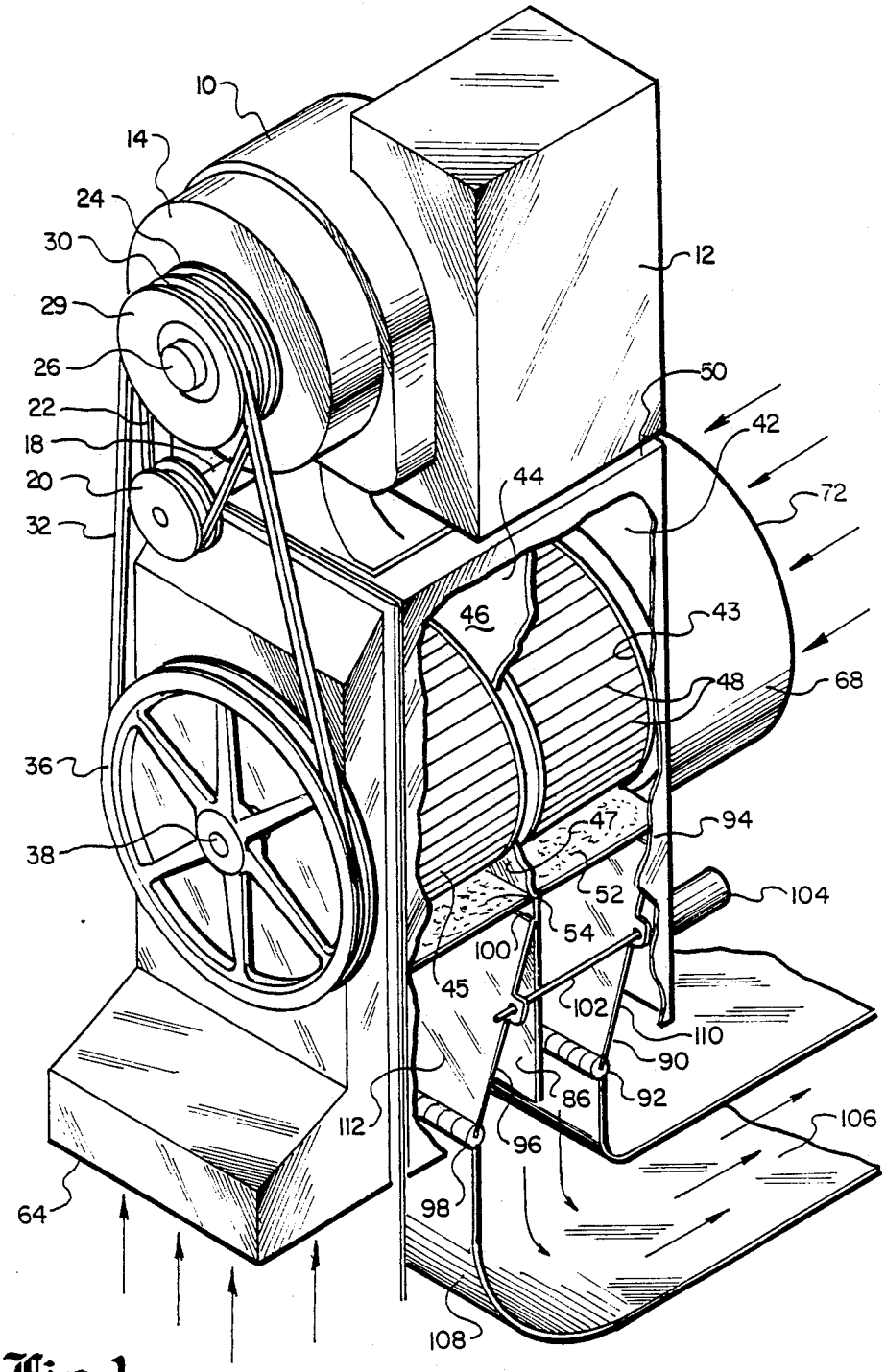
FIG. 1 is a perspective view, partially cut away, of the combination unit of the present invention.

The unit for alternatively space heating and cooling has a compressor 10 for compressing a working fluid. As is conventional, the compressor pressurizes the refrigerant, usually Freon or ammonia. Pressurization heats the fluid. It then flows through tubes (not shown) to a condenser 70, a heat exchanger, where the heat is expelled to the atmosphere. The fluid still retains its high pressure. From the condenser through other lines (not shown), the refrigerant passes into an evaporator 62 where it expands. In the process of expanding or descreasing in pressure, the refrigerant cools. A heat exchanger associated with the evaporator allows the evaporator to cool air which is then used for air conditioning. The refrigerant from the evaporator then recycles to the compressor.

Compressor 10 in the exemplary embodiment is mounted on the upper portion of blower housing 50. So that the entire unit may be portable, compressor 10 is driven by a gasoline or diesel engine 12. Engine 12 drives shaft 18, which in turn drives belt 22, pulley 24 and shaft 26 to drive compressor 10.

The compressor may be driven by an electric motor 14. A clutch (not shown) connects the motor to shaft 26. The centrifugal clutch can also be used to allow the electric motor to act as a starter for the engine.

Pulleys 24 and 29 rotate together. Belt 32 extends between pulley 29 to blower pulley 36. Rotation of pulley 36 rotates shaft 38 to operate centrifugal blower 40. Clutch 30 between pulleys 24 and 29 and the internal motor clutch allow engine 12 or electric motor 14 to operate the blower without operating compressor 10.

When the system operates, engine 12 runs compressor 10, and centrifugal blower 40 is rotating. The compressed and heated refrigerant flows through conventional tubing (not shown) into condenser 70. The condenser is supported by condenser housing 68, which extends to the side of blower housing 50. Blower 40 pulls into it ambient air to one side 72 of the heat exchange surfaces of condenser 70, through condenser housing 68 and into right inlet 58 (FIGS. 2 and 3) of blower 40. The ambient air cools the refrigerant in condenser 70 and becomes warmer in the process.

The refrigerant from condenser 70 passes through tubing (not shown) to evaporator 62. As is known in refrigeration, the compressed refrigerant is expanded within evaporator 62 and the resultant decrease in pressure decreases the temperature. Blower 40 pulls air through inlet 64, past the heat exchanging members (not shown) of evaporator 62, through duct 60 and into the left (FIGS. 2 and 3) inlet of blower 40. The air pulled past evaporator 62 is then cooled and can be used for air conditioning.

Blower 40 of the present invention has been improved by having dividing means in the blower for blocking mixing of the air from the condenser and from the evaporator in the blower and maintaining the air in first and second flows. In the exemplary embodiment, blower 40 is of the centrifugal type. Blades 48 are spaced about the rim of the blower. The rim is supported by spokes (not shown) extending outward from shaft 38. As the rim revolves around the longitudinal axis, outside air is pulled into inlets 56 and 58 and pulled radially to the outside. Most of the blower is surrounded by blower housing 50, but in the exemplary embodiment, the bottom of the housing is open at 52 and 54 (FIG. 1) so that the air is expelled downward through the openings.

Dividing plate 46 is attached to the shaft at approximately the longitudinal center of the blower in the exemplary embodiment, but its longitudinal position could be modified. Plate 46 prevents mixing of air from two flow paths, a first flow path past condenser and into inlet 58 and a second flow past evaporator 62 through inlet 56. Thus, warm air remains on the right side 42 (FIGS. 2 and 3) of blower 40, and cool, air conditioned air remains on the left side 44 of the blower. Dividing plate 46 can contact the inside of the rim that supports blade 48, but a plate sealed to the rim is not necessary to maintain separation between the warm and cold flows.

As an alternative to having divider plate 46 mounted on shaft 38 for rotation with blower 40, the blower could be provided with two separate, half-wide blower units 43 and 45 (FIG. 1), which rotate together. The two blower halves are separated by a divider plate 47 that does not rotate.

Figure 3:
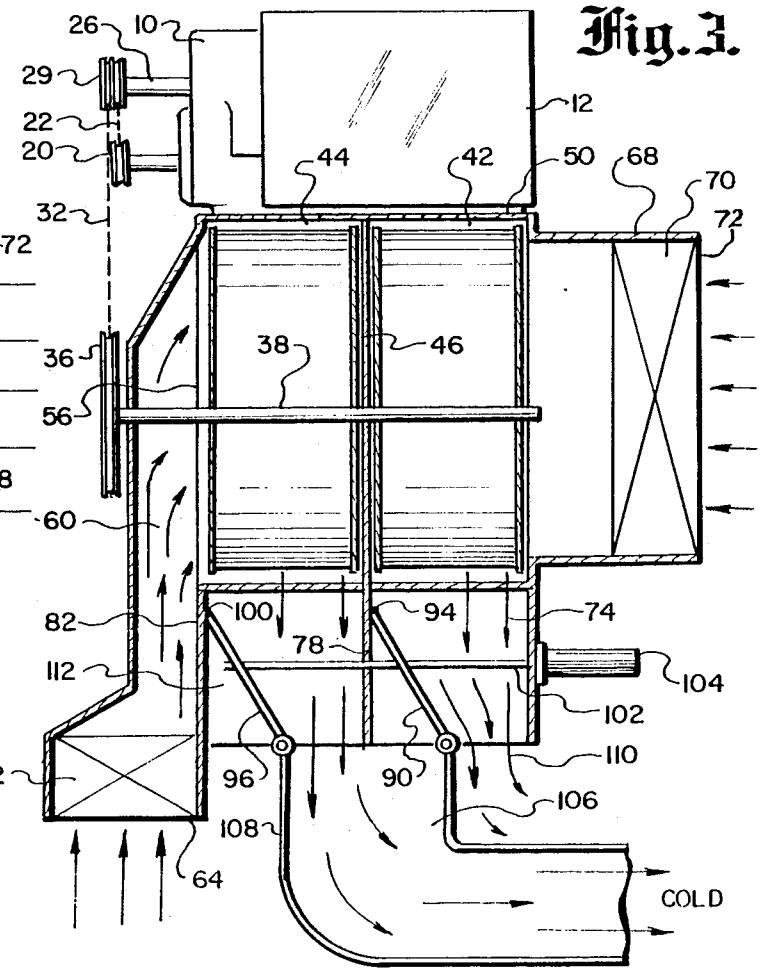
FIG. 3 is a view similar to FIG. 2, but the valve is in the other position, cold air is flowing through the outlet and warm air is being exhausted.

A valve is provided in the path of the first and second air flows for (1) directing the first flow to an outlet and exhausting the second flow, (2) exhausting the first flow and directing the second flow to an outlet or (3) mixing some of the first flow with some of the second flow to the outlet and mixing the rest of the air in the exhaust. In the exemplary embodiment, blower 40 exhausts air downward through openings 52 and 54. The first flow (warm air from condenser 70 on the right side 42 of blower 40) continues as a first flow 74 through opening 52 and into passage 84 between center plate 78 and right side plate 80. Cool air from evaporator 62 stays on the left side 44 of blower 40 and emerges as second flow 76 through opening 54 and into passage 86 between center plate 78 and left side plate 82. In the exemplary embodiment, right or first valve plate 90 is mounted to pivot on end 92 on the upstream end of a wall 108 of duct 106. Pivot 92 permits first valve plate 90 to pivot between a position such that the end 94 of plate 90 can move between a position against right side wall 80 (FIG. 2) and center plate 78 (FIG. 3). The end 94 of first valve plate 90 may have an edge of rubber or other soft material for improved sealing and to minimize noise when the valve plate strikes the center side wall. Likewise, second valve plate 96 pivots about point 98 on duct wall 108 between a position such that the upper edge 100 of second valve plate 96 is against center wall 78 (FIG. 2) or left side wall 82 (FIG. 3).

Connecting means in the form of rod 102 attaches to first valve plate 90 and second valve plate 96 so that the valve plates pivot together. Rod 102 extends into motive means such as solenoid 104, and the solenoid extends or retracts rod 102 under the influence of automatic thermostatic controls (not shown).

Figure 2:
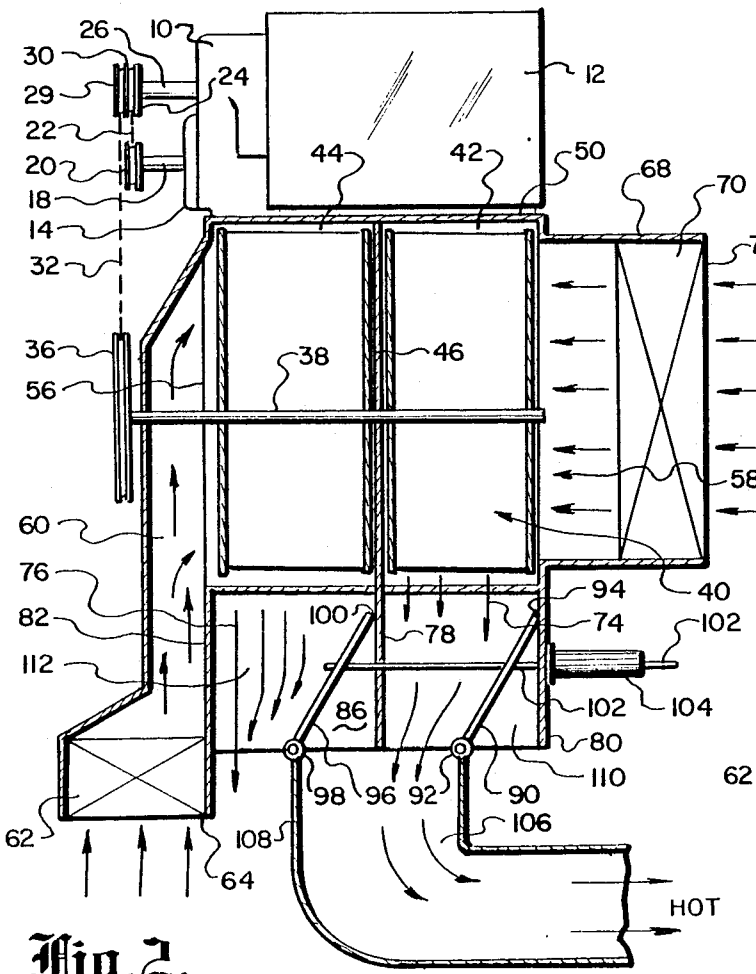
FIG. 2 is a front, sectional view of the unit of the present invention with the valve in a position such that cold air is being exhausted and warm air is proceeding through the outlet.

FIG. 2 shows the configuration of the system when hot air is to be delivered through duct 106. First valve plate 90 is against right side plate 80, and second valve plate 96 is against center wall 78. The warm air from condenser 70 and the right side 42 of blower 40 is a first flow path flowing downward between center plate 78 and first valve plate 90 where it flows into duct 106. Second flow 76, which is cooler air from evaporator 62 and the left side 44 of blower 40 passes between valve plate 96 and left wall 82 where it is exhausted as exhaust 112 to the atmosphere. When cold air is desired, the controls move valve plates 90 and 96 to the FIG. 3 position. As a result, the warm air through condenser 70 and right side 42 of blower 40 flows between valve plate 90 and right side wall 80 where it is exhausted as exhaust 110, but the cooler, desired air from evaporator 62 flows through left side 44 of blower 40 between left valve plate 96 and center wall 78, where it is directed into duct 106. Thus, merely by changing the position of the valve plates 90 and 96, one can choose between a hot air output (FIG. 2) or a cold air output (FIG. 3).

One may also want the dehumidifying from air conditioning but not all of the cooling. This can be accomplished by having intermediate positions for the valve. If valve plates 96 and 90 are vertical, for example (FIG. 2), parts of cool flow 76 and warm flow 74 are exhausted. The remainder of the flow is directed to outlet duct 106. If this option is desired, a mechanism that allows for selected positions of plates 90 and 96 would be required.

Various modifications and changes may be made in the configuration described above that come within the spirit of this invention. The invention embraces all such changes and modifications coming within the scope of the appended claims.

I claim:

1. In a unit for alternatively space heating or cooling, which includes a compressor for compressing a working fluid, a condenser for expelling heat from the compressed working fluid, an evaporator for expanding working fluid to cool the working fluid interconnected to each other, blower means adjacent the condenser and the evaporator for drawing ambient air through the condenser and the evaporator into the blower means;

divider means in the blower means for blocking mixing of the air from the condenser and from the evaporator in the blower means and maintaining air in first and second air flows;

valve means in the path of the first and second air flows for directing at least a first portion of the first air flow to an outlet and exhausting at least a first portion of the second air flow or exhausting at least a first portion of the first air flow and directing at least a first portion of the second air flow to an outlet, the improvement comprising:

the provision of the valve means having a center wall aligned with the dividing means and two side walls on each side of the center wall; and a pair of valve plates, one on each side of the center wall, each pivoting between a sidewall and the center plate.

2. In the unit of claim 1, the improvement further comprising the provision of connecting means connecting the valve plates together and motive means attached to the connecting means for moving the connecting means and pivoting the valve plate simultaneously.

* * * * *